US007025691B2

(12) United States Patent
Matsumoto et al.

(10) Patent No.: US 7,025,691 B2
(45) Date of Patent: Apr. 11, 2006

(54) GOLF PUTTER SHAFT

(75) Inventors: Norio Matsumoto, Haramachi (JP); Tetsuto Minowa, Haramachi (JP)

(73) Assignee: Fujikura Rubber Ltd., Tokyo (JP)

( * ) Notice: Subject to any disclaimer, the term of this patent is extended or adjusted under 35 U.S.C. 154(b) by 0 days.

(21) Appl. No.: 10/897,525

(22) Filed: Jul. 23, 2004

(65) Prior Publication Data

US 2005/0020375 A1 Jan. 27, 2005

Related U.S. Application Data

(62) Division of application No. 10/329,030, filed on Dec. 24, 2002, now abandoned.

(30) Foreign Application Priority Data

Dec. 27, 2001 (JP) ..... 2001-395675

(51) Int. Cl.
*A63B 53/10* (2006.01)

(52) U.S. Cl. ..... 473/316; 473/319

(58) Field of Classification Search ..... 473/316–323
See application file for complete search history.

(56) References Cited

U.S. PATENT DOCUMENTS

| | | | | |
|---|---|---|---|---|
| 2,066,962 | A | 1/1937 | Cross | |
| 2,100,307 | A | 11/1937 | McMinn | |
| 3,519,270 | A * | 7/1970 | Baymiller | 473/313 |
| 5,429,008 | A | 7/1995 | Matsumoto et al. | |
| 5,505,447 | A * | 4/1996 | Mockovak | 473/308 |
| 5,573,468 | A | 11/1996 | Baumann | |
| 6,176,792 | B1 * | 1/2001 | Tate | 473/286 |
| 6,485,376 | B1 | 11/2002 | Hisamatsu | |

FOREIGN PATENT DOCUMENTS

| | | | |
|---|---|---|---|
| GB | 30050 | | 12/1912 |
| JP | 7-148294 | * | 6/1995 |
| JP | 2000-51413 | * | 2/2000 |

* cited by examiner

*Primary Examiner*—Stephen Blau
(74) *Attorney, Agent, or Firm*—McCormick, Paulding & Huber LLP

(57) ABSTRACT

In a putter shaft having a tip end and a butt end, a curvature of the putter shaft is represented by a curvature curve of the putter shaft which increases monotonously from the tip end to the butt end. The curvature curve is defined as a curve showing variation of the curvature in a longitudinal axis direction of the putter shaft in a state where a load acts on the tip end to deform the putter shaft with the putter shaft being fixed at the butt end.

5 Claims, 9 Drawing Sheets

GOLF PUTTER SHAFT

CROSS REFERENCE TO PRIOR APPLICATIONS

The present application claims priority to Japanese Patent Application No. 2001-395675, filed Dec. 27, 2001 and is a Divisional Application of abandoned U.S. Patent Application Ser. No. 10/329,030 filed Dec 24, 2002, both applications being incorporated by reference.

BACKGROUND OF THE INVENTION

1. Field of the Invention

The present invention relates to a golf putter, and more specifically to improvements in a putter shaft.

2. Description of the Related Art

A golf putter is generally required to have characteristics such as the following:

(1) The golf putter should have a sufficient weight so as not to be easily moved by slight movements of small muscles such as those in the fingers or wrists;

(2) The golf putter should have the moment of inertia by which a golf player can feel the weight thereof which is controllable during a putting stroke;

(3) When a putting stroke is executed, during the downswing, the putter shaft should flex gradually and evenly from the butt (at the hand) to the putter head in a flexing direction wherein the putter head swings down slower, and during the subsequent follow-though, the putter shaft should return gradually and evenly from the butt to the putter head (namely, the putter shaft should flex smoothly and subsequently return to the original shape smoothly with constant rhythm);

(4) The putter shaft should be capable of applying proper forward rotation (over spin) to the ball easily;

(5) The putter shaft should always convey a player's movement to the ball in the same way; and (6) The putter shaft should be small in energy loss caused by the striking (hitting) point of the putter head.

In these characteristics, the sufficient weight in the above characteristic (1) and the moment of inertia in the above characteristic (2) are comparatively easy to set up, while each of the above characteristics (5) and (6) is almost equivalent to a characteristic given to the putter shaft when isotropy (the quality of exhibiting properties with the same values when measured along axes in all directions) is given to the putter shaft. The putter shaft made of an isotropic material can reduce the shake of the putter head no matter which point of the putter head the ball hits. Namely, no matter which direction tension is applied to the putter shaft from, the putter shaft made of an isotropic material can support the putter head with substantially the same reaction. Although isotropy depends on the quality of the material (steel being an isotropic material), a carbon shaft which consists of CFRP (carbon fiber reinforced plastic) cannot be said to have isotropy unless it uses a triaxial woven fabric.

On the other hand, the above characteristics (3) and (4) are closely related to each other. Specifically, if the shaft of a golf putter has the above characteristic (3), proper forward rotation (over spin) can be applied to the ball by hitting the ball while stroking it from bottom up with the golf putter; reverse rotation is applied to the ball if the ball is hit from top down with the golf putter. In this connection, the ball to which forward rotation is given from the beginning tends to roll well and proceeds in a desired direction, whereas the ball to which reverse rotation is given from the beginning tends not to roll well nor proceed in a desired direction. This is because the ball to which reverse rotation is applied at a putting stroke by the golf putter normally moves forward while sliding along a putting green at the beginning, and thereafter the rotational speed of the ball gradually decreases due to the resistance of the grass on the putting green, and finally the ball first stops rotating reversely to thereafter start rotating forward. This change of rotational direction of the ball from reverse to forward causes the ball to lose the inertial force thereof, and the aiming accuracy is lost in that process. For instance, a serial-stepped steel putter shaft does not flex smoothly during a putting stroke, and accordingly cannot have the above characteristics (3) and (4).

SUMMARY OF THE INVENTION

The present invention has been devised in view of the problems noted above, and provides a golf putter shaft which flexes smoothly from butt to tip and subsequently returns to its original shape smoothly from butt to tip with constant rhythm when a putting stroke is executed, i.e., provides a golf putter shaft with which proper forward rotation is easily applied to the ball. The present invention further provides a golf putter having such a putter shaft.

According to an aspect of the present invention, a putter shaft having a tip end and a butt end is provided, wherein a curvature of the putter shaft which is represented by a curvature curve of the putter shaft increases monotonically from the butt end to the tip end. The curvature curve is defined as a curve showing variation of the curvature in a longitudinal axis direction of the putter shaft in a state where a load acts on the tip end to deform the putter shaft with the putter shaft being fixed at the butt end.

It is desirable for the putter shaft to be horizontally oriented and fixed at the butt end to form a cantilever before the load acts on the tip end.

The putter shaft can be a carbon shaft, wherein at least one ply of triaxial woven fabric is wrapped around the putter shaft.

In another embodiment, a putter shaft having a tip end and a butt end is provided, wherein a flexural rigidity of the putter shaft which is represented by a flexural rigidity distribution curve of the putter shaft decreases monotonically from the butt end to the tip end, wherein the flexural rigidity distribution curve is defined as a curve showing variation of the flexural rigidity in a longitudinal axis direction of the putter shaft.

The putter shaft can be a carbon shaft, wherein at least one ply of triaxial woven fabric is wrapped around the putter shaft.

In another embodiment, a golf putter including the above-mentioned putter shaft is provided.

BRIEF DESCRIPTION OF THE DRAWINGS

The present invention will be described below in detail with reference to the accompanying drawings in which.

DESCRIPTION OF THE PREFERRED EMBODIMENTS

Figure 1:
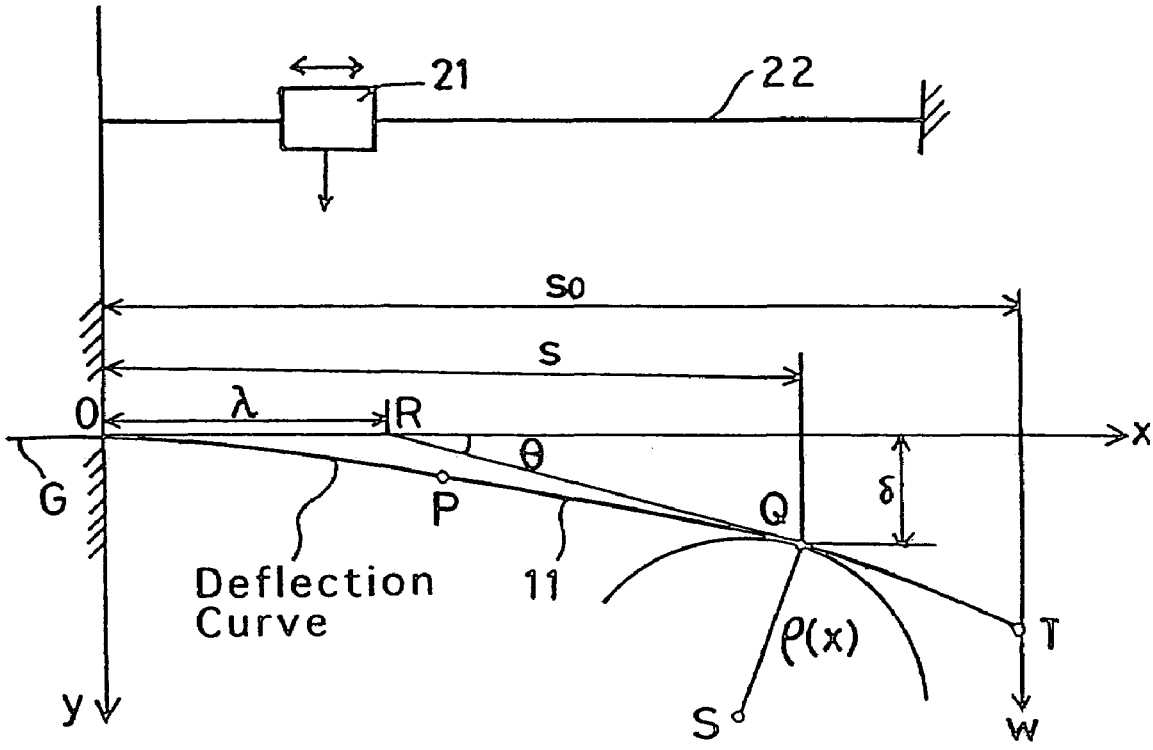
FIG. 1 is an explanatory skeleton diagram showing a method of determining a curvature of a golf club shaft.

First of all, an example of a method of determining a curvature curve of a golf club shaft which has been proposed in Japanese unexamined Patent Publication No. 6-105934 will be hereinafter discussed with reference to FIG. 1.

A shaft 11 of a golf club is horizontally oriented along an x-axis of a Cartesian coordinate system, and fixed at a butt end G of the shaft 11 to form a cantilever. The butt end G of the cantilever (i.e., club shaft 11), is fixed at the origin 0 of the coordinate system. The club shaft 11 has a length So. If a predetermined load W acts on the free end (tip end) T of the club shaft 11, the club shaft 11 is deflected or resiliently deformed as shown in FIG. 1. In this state where the load W acts on the free end T, the amount of displacement of the club shaft 11 from the x-axis is measured at a plurality of points on the club 11 from the fixed point 0 to the free end T. From the results of this actual measurement, an approximate deflection curve of the golf club 11 in the loaded condition is determined, and from this approximate deflection curve, a curvature curve of the club shaft 11 which shows the variation of the curvature of the club shaft 11 in the longitudinal axis direction is determined.

A guide rail 22 which extends horizontally to be parallel to the x-axis is fixedly disposed above the club shaft 11, the butt end G of which is fixed. A measuring unit 21 is supported by the guide rail 22 to be guided along the guide rail 22 thereon. The measuring unit 21 is of a known type which is provided with a laser emitter and a light receiver; the laser emitter emits a laser beam while the light receiver receives the laser beam reflected by an object to be measured to measure a distance to the object. In this particular example shown in FIG. 1, an amount of displacement y (x) of the club shaft 11 from the x-axis, along which the club shaft 11 extends when no load is acted thereon, is measured in a state where the load W acts on the free end T of the club shaft 11. The amount of displacement y (x) ($0 \leqq x \leqq s$) is measured at predetermined intervals on the club shaft 11 along the longitudinal direction thereof (e.g., at every 15 mm).

From the measured amounts of displacement y (x) of the club shaft 11, the aforementioned curvature curve is approximately determined. To begin with, an approximate deflection curve y (x) can be expressed as a hexanomial expression such as noted below:

$$y(x)=a_6x^6+a_5x^5+\ldots+a_1x+a_0$$

The coefficients in this hexanomial expression ($a_6$ through $a_0$) can be determined relative to the actual measured values y(x) by the least-square method.

On the other hand, the following equation (1) is satisfied between the approximate deflection curve y(x) and a curvature lip 1/ρ (x) in a range where the amount of deformation of the club shaft 11 is small.

$$\frac{1}{\rho(x)}=\frac{\frac{d^2y}{dx^2}}{\left\{1+\left(\frac{dy}{dx}\right)^2\right\}^{2/3}}\cong\frac{d^2y}{dx^2}$$

Accordingly, the curvature curve is determined by differentiating the approximate deflection curve y(x) two times.

The approximate deflection curve y(x) is differentiated twice as follows:

$$y'(x)=6\cdot a_6x^5+5\cdot a_5x^4+\ldots+2\cdot a_2x+a_1$$

$$y''(x)=5\cdot 6\cdot a_6x^4+4\cdot 5\cdot a_5x^3+\ldots+1\cdot 2\cdot a_2$$

Since the curvature curve obtained by the two differentiations shows the variation of the curvature of the club shaft 11 in the longitudinal axis direction thereof, the flexural characteristic of the club shaft 11 can be shown microscopically. In FIG. 1, ρ (x) represents the radius of a circle of curvature at a given x-coordinate on the deflection curve y(x), and S represents the center of the circle of curvature.

Figure 2:
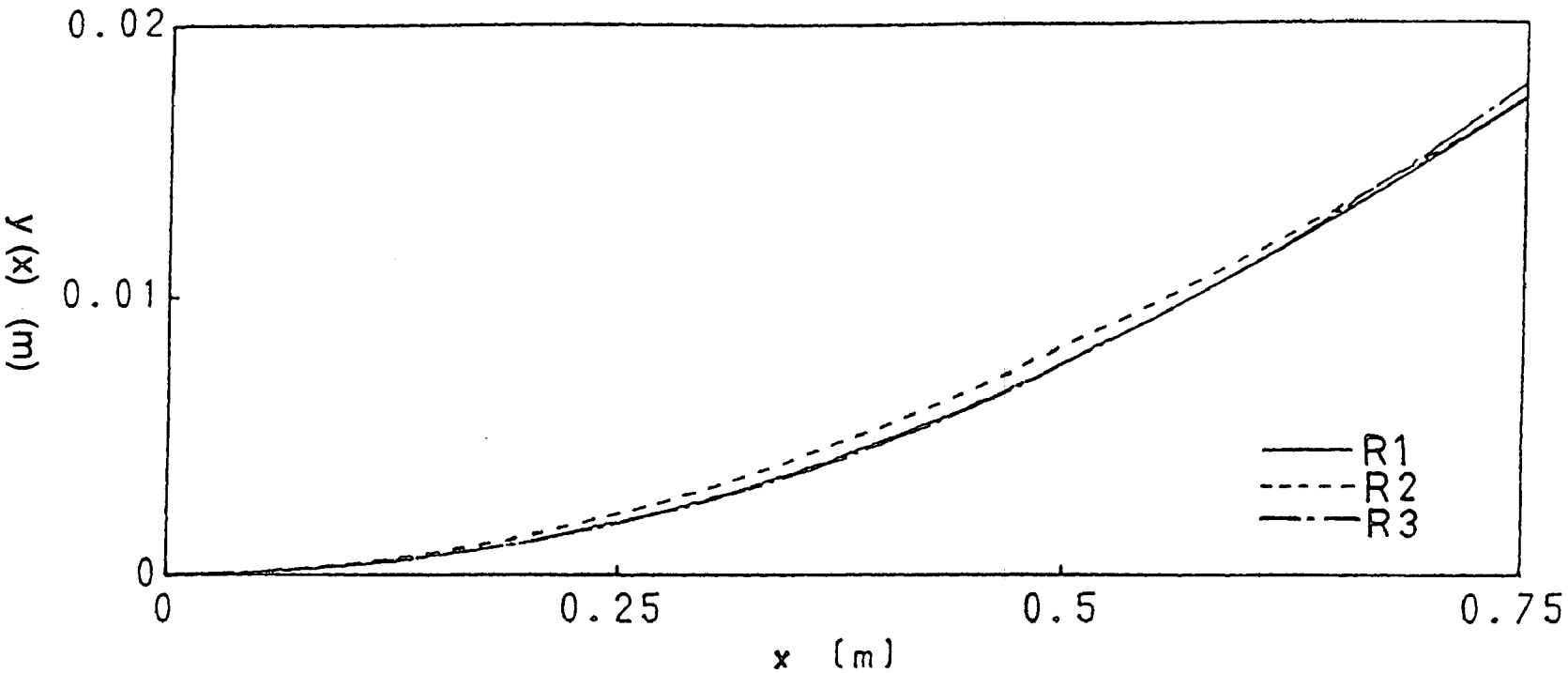
FIG. 2 is a graph showing examples of approximate deflection curves R1, R2 and R3 of three conventional club shafts each having flexural rigidity R.
Figure 3:
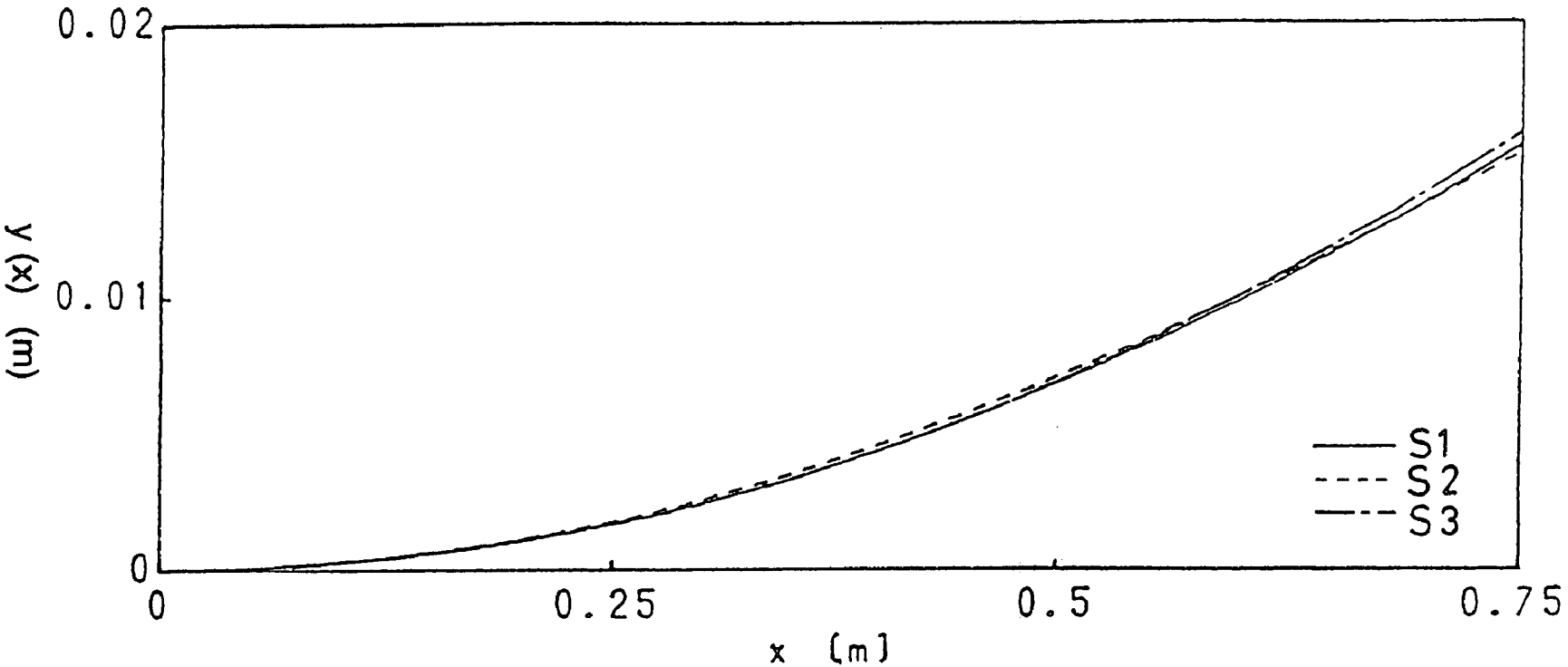
FIG. 3 is a graph showing examples of approximate deflection curves S1, S2 and S3 of three conventional club shafts each having flexural rigidity S.
Figure 4:
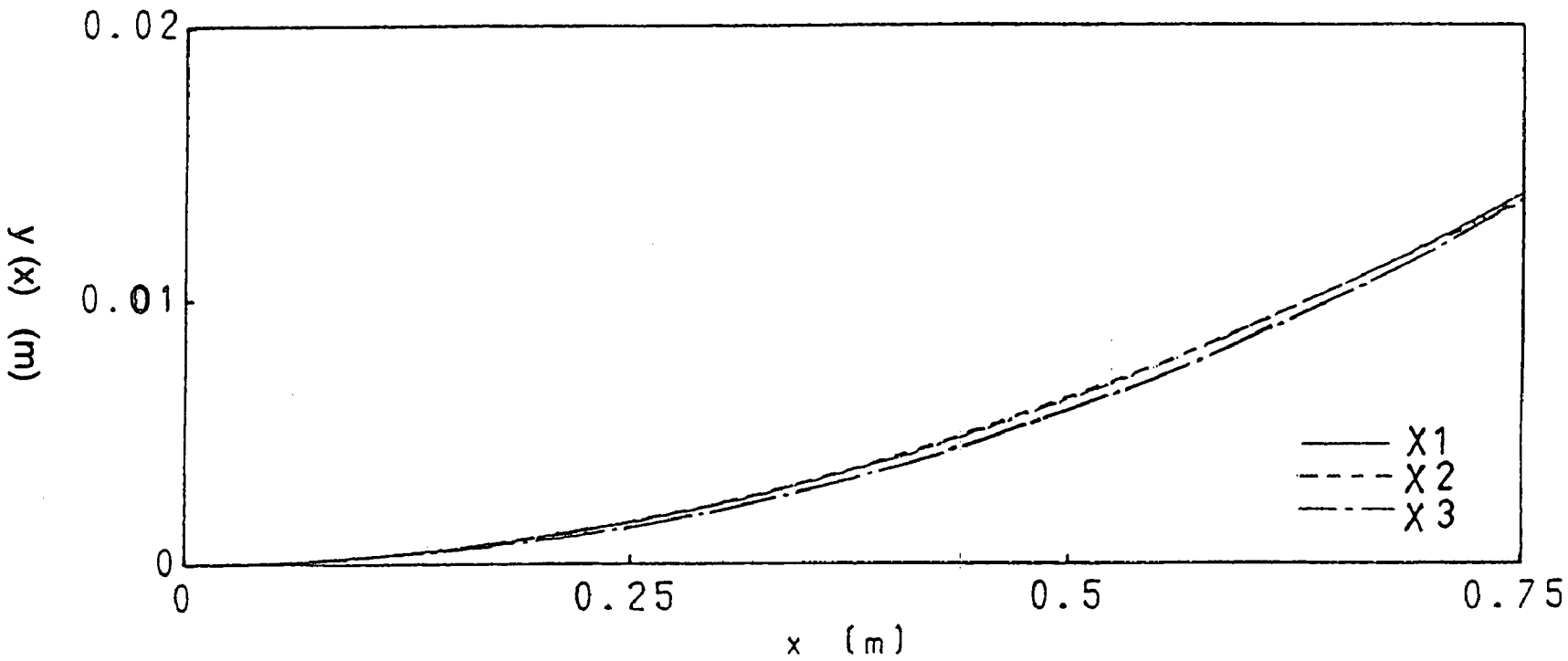
FIG. 4 is a graph showing examples of approximate deflection curves XI, X2 and X3 of three conventional club shafts each having flexural rigidity x.
Figure 5:
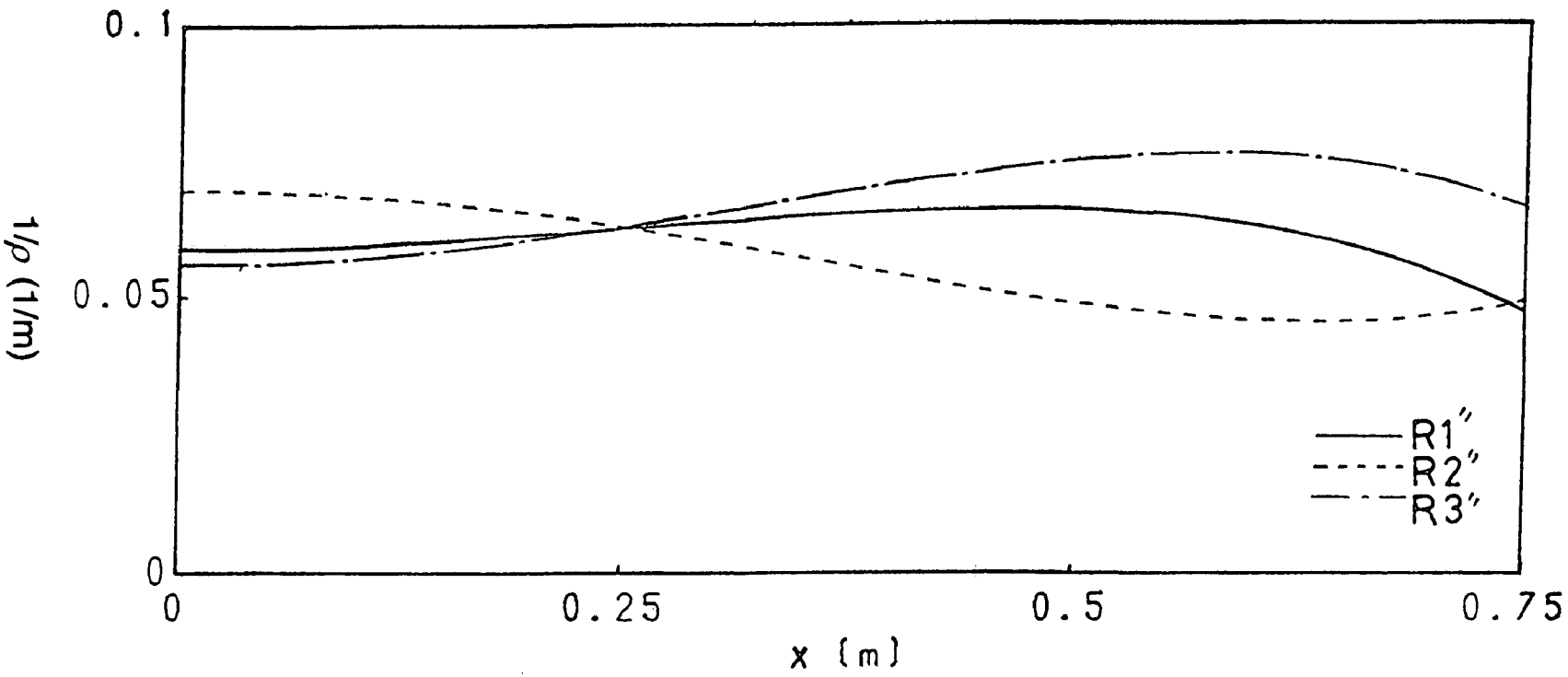
FIG. 5 is a graph showing three curvature curves R1", R2" and R3" determined from the three approximate deflection curves shown in FIG. 2, respectively.
Figure 6:
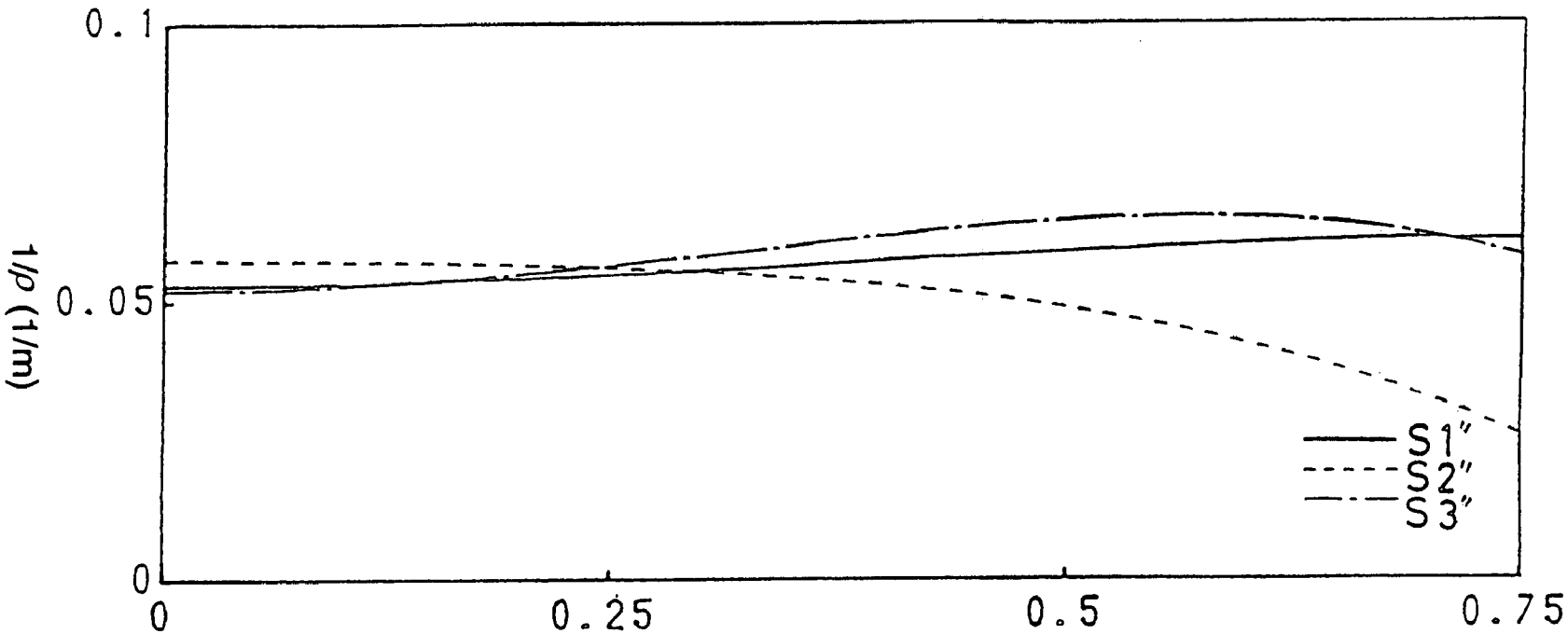
FIG. 6 is a graph showing three curvature curves SI", S2" and S3" determined from the three approximate deflection curves shown in FIG. 3, respectively.
Figure 7:
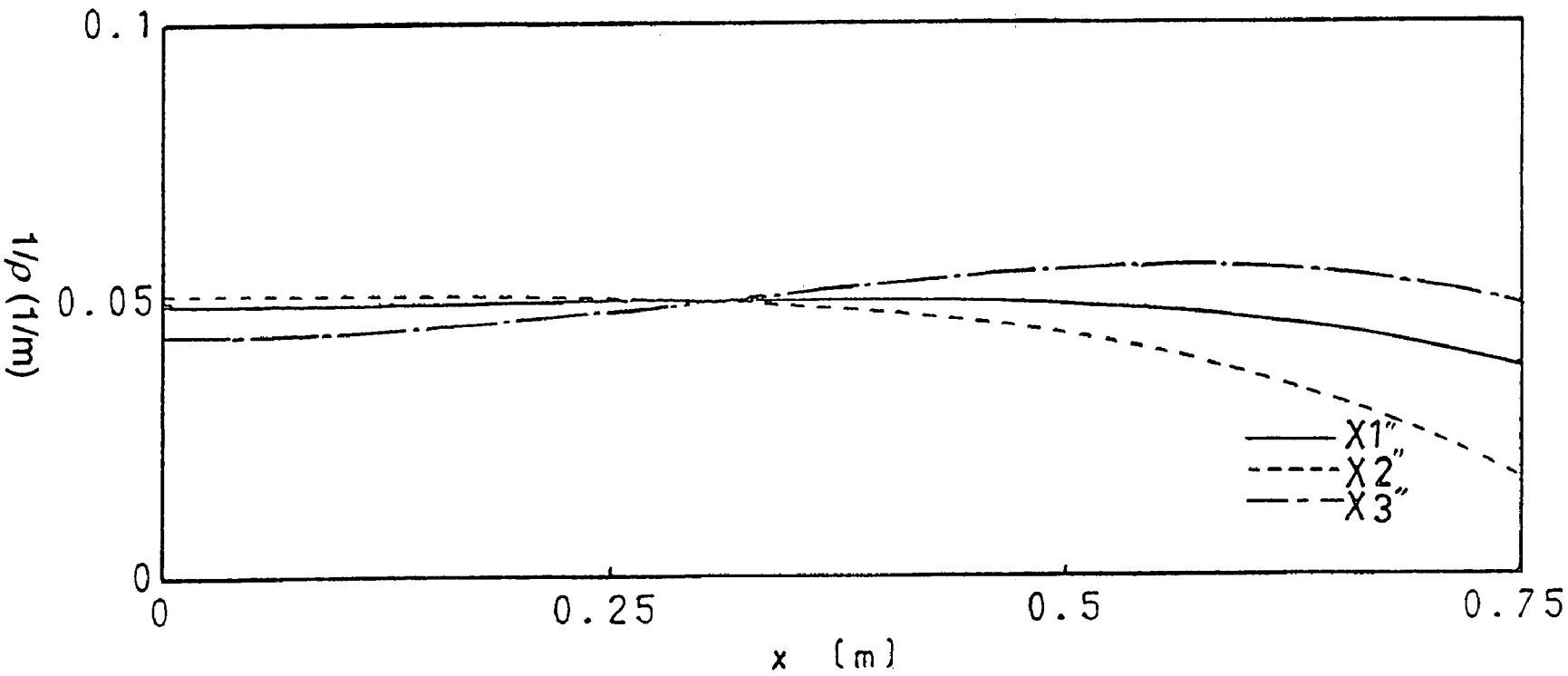
FIG. 7 is a graph showing three curvature curves XI", X2" and X3" determined from the three approximate deflection curves shown in FIG. 4, respectively.

FIGS. 2, 3 and 4 each show examples of approximate deflection curves of three conventional club shafts 11 each having the same flexural rigidity by actual measurement, and FIGS. 5, 6 and 7 each show three curvature curves determined from the three approximate deflection curves shown in FIGS. 2, 3 and 4, respectively.

Specifically, FIG. 2 shows examples of approximate deflection curves R1, R2 and R3 of three conventional club shafts 11 each labeled "R" (a conventional notation to define flexural rigidity (Flex) of a club shaft), FIG. 3 shows examples of approximate deflection curves SI, S2 and S3 of three conventional club shafts 11 each labeled "S" (a conventional notation to define flexural rigidity of a club shaft), and FIG. 4 shows examples of approximate deflection curves XI, X2 and X3 of three conventional club shafts 11 each labeled "X" (a conventional notation to define flexural rigidity of a club shaft). "Flex" is a conventional index for the hardness of a club shaft. Measurements are taken of the amount of force required to bend a club shaft by a certain amount, and this value becomes the basis for flex ratings (the higher the number, the stronger the shaft). In ascending order of strength, the flex of a material is designated as follows:

LL>L>A>RA>R>SR>S>SX>X>XX

From the approximate deflection curves shown in each of FIGS. 2, 3 and 4, it is difficult to see the difference among the three conventional club shafts 11.

On the other hand, FIG. 5 shows three curvature curves R1", R2" and R3" determined from the three approximate deflection curves R1, R2 and R3 shown in FIG. 2, respectively, FIG. 6 shows three curvature curves S1", S2" and S3" determined from the three approximate deflection curves S1, S2 and S3 shown in FIG. 3, respectively, and FIG. 7 shows three curvature curves X1", X2" and X3" determined from the three approximate deflection curves X1, X2 and X3 shown in FIG. 4, respectively. Each curvature curve shown in each of FIGS. 5, 6 and 7 shows the variation of the curvature of the club shaft 11 in the longitudinal axis direction, and also shows the flexural characteristic of the club shaft 11 microscopically.

The curvature curves shown in FIGS. 5 through 7 are those shown in the above noted Japanese unexamined Patent publication No. 6-105934. In each curvature curve, it can be seen that the curvature 1/ρ (x) firstly increased and subsequently decreased, or firstly decreases and subsequently increases. All the curvature curves shown in FIGS. 5 through 7 are determined by actual measurement of the club shafts of regular drives or irons.

Figure 8:
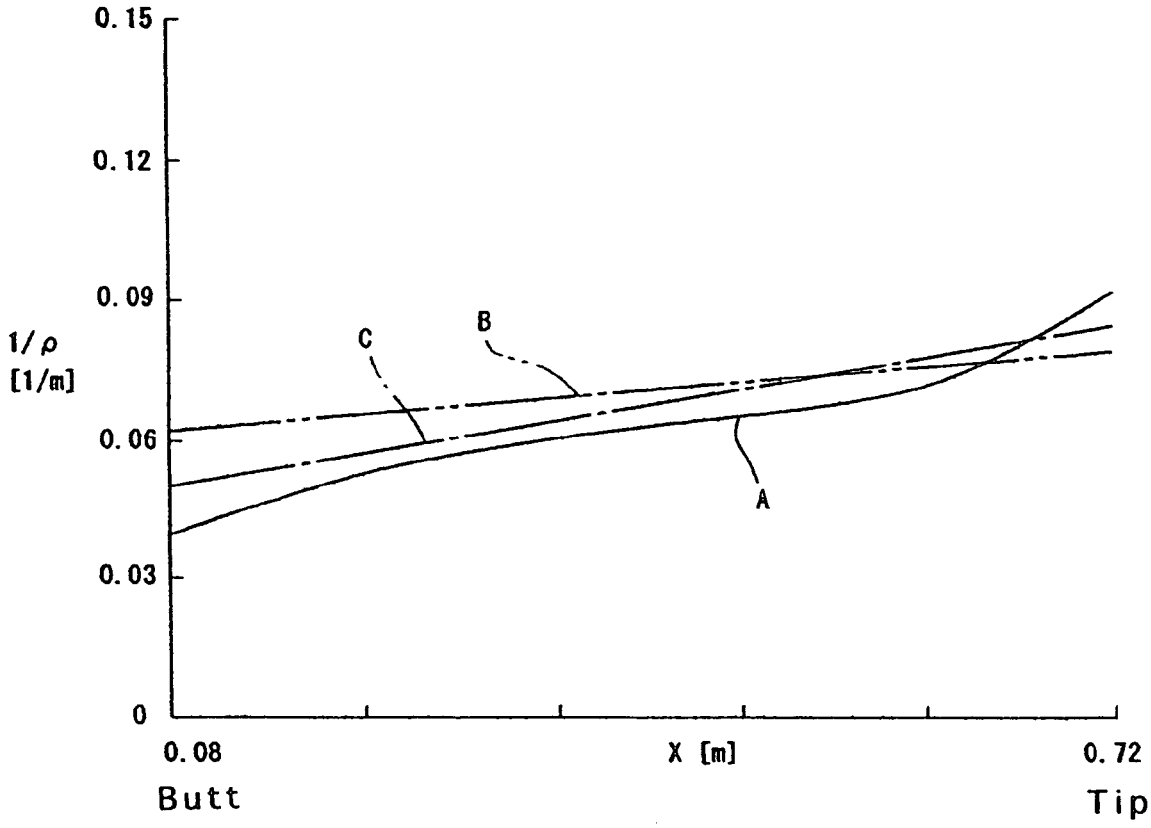
FIG. 8 is a graph showing examples of curvature curves of putter shafts according to the present invention.

The inventors of the present invention have found that a golf putter flexes smoothly from butt to tip and subsequently returns to its original shape smoothly from butt to tip with constant rhythm during a putting stroke if the curvature of the shaft of the golf putter, which is represented by the curvature curve of the shaft of the golf putter, monotonically increases from butt end to tip end thereof. FIG. 8 shows examples of curvature curves of putter shafts according to the present invention. Although the curvature curve C in FIG. B shows a curvature curve of an ideal putter shaft in which the curvature of the putter shaft increases monotonically and linearly from butt end to tip end, either the curvature curve A or B in FIG. 8, both of which indicate the curvature of the putter shaft increasing monotonically and nonlinearly from butt end to tip end (which may have no variation section), is also satisfactory.

In regard to the relationship between the curvature 1/ρ (x) and the flexural rigidity EI (x), the following equation is satisfied:

$$1/\rho(x)=M(x)/(EI(x))$$

wherein M(x) represents the moment.

Figure 9:
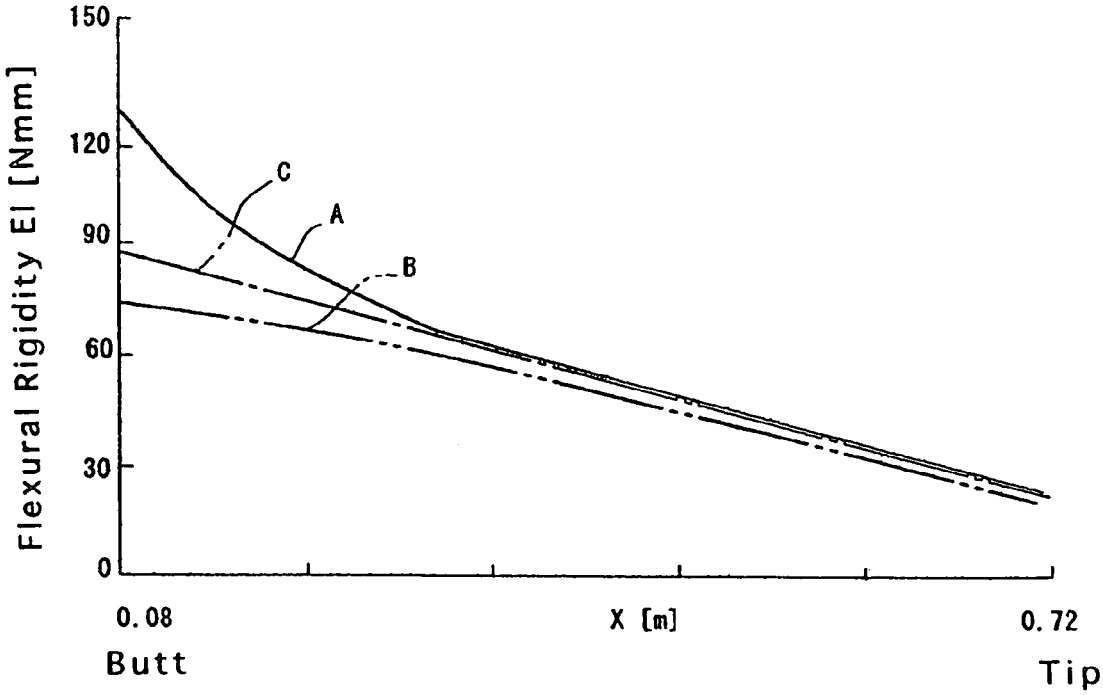
FIG. 9 is a graph showing examples of flexural rigidity distribution curves of putter shafts according to the present invention.

Therefore, in terms of a flexural rigidity distribution curve, the putter shaft according to the present invention is characterized by the flexural rigidity distribution curve which shows the flexural rigidity of the putter shaft decreasing monotonically from butt end to tip end. If such a putter shaft is employed, a golf putter flexes smoothly from butt to tip and subsequently returns to its original shape smoothly from butt to tip with constant rhythm when a putting stroke is executed. FIG. 9 shows examples of flexural rigidity distribution curves of putter carbon shafts according to the present invention. Although the flexural rigidity distribution curve C in FIG. 9 shows a rigidity distribution curve of an ideal putter shaft in which the flexural rigidity of the putter shaft ideally decreases monotonically and linearly from butt end to tip end, either the flexural rigidity distribution curve A or B, both of which indicate the flexural rigidity of the putter shaft decreasing monotonically and nonlinearly from butt end to tip end (which may have no variation section), is also satisfactory.

Figure 10:
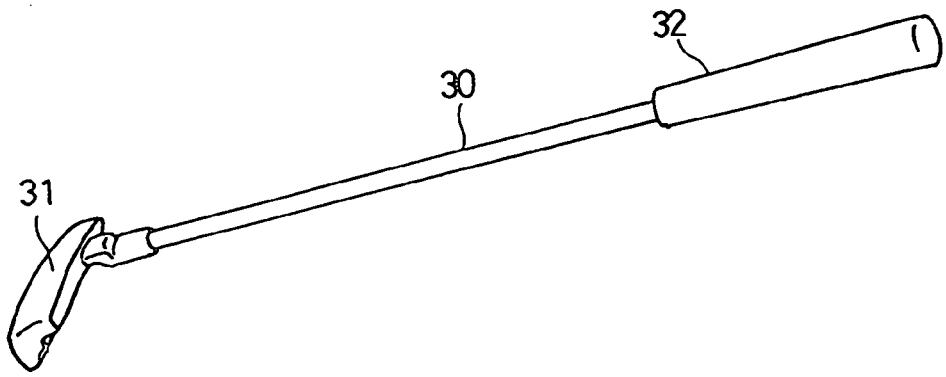
FIG. 10 is a perspective view of a golf putter having an embodiment of a putter shaft according to the present invention.

A person skilled in the art can easily manufacture a club shaft which exhibits a curvature curve or a flexural rigidity distribution curve such as shown in FIGS. 8 or 9 in either filament winding type or pre-preg type if the club shaft is, e. g., a carbon shaft. The same is true for a steel shaft. The carbon shaft according to the present invention is desirably made as a carbon shaft around which at least one ply of triaxial woven fabric is wrapped to give an isotropy or quasi-isotropy to the carbon shaft. FIG. 10 is a perspective view of an embodiment of a golf putter having a putter shaft 30 according to the present invention. In this golf shaft, a putter head 31 and a grip 32 are fixed to the tip end and the butt end of the putter shaft 30, respectively.

As can be understood from the above description, according to the present invention, a golf putter shaft which flexes smoothly from butt to tip and subsequently returns to its original shape smoothly from butt to tip with constant rhythm when a putting stroke is executed (i.e., a golf putter shaft with which proper forward rotation is easily applied to the ball) is achieved. Furthermore, according to the present invention, a golf putter having such a putter shaft is achieved.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A golf putter comprising a putter shaft having a tip end and a butt end, wherein a curvature of said putter shaft which is represented by a curvature curve of said putter shaft increases monotonically from said butt end to said tip end; wherein said curvature curve is defined as a curve showing variation of said curvature in a longitudinal axis direction of said putter shaft in a state where a load acts on said tip end to deform said putter shaft with said putter shaft being fixed at said butt end.

2. The golf putter according to claim 1, wherein said putter shaft is horizontally oriented and fixed at said butt end to form a cantilever before said load acts on said tip end.

3. The golf putter according to claim 1, wherein said putter shaft comprises a carbon shaft, wherein at least one ply at triaxial woven fabric is wrapped around said putter shaft.

4. A golf putter comprising a putter shaft having a tip end and butt end, wherein a flexural rigidity of said putter shaft which is represented by a flexural rigidity distribution curve of said putter shaft decreases monotonically from said butt end to said tip end, wherein said flexural rigidity in a longitudinal axis direction of said putter shaft.

5. The golf putter according to claim 4, wherein said putter shaft comprises a carbon shaft, wherein at least one ply of triaxial woven fabric is wrapped around said putter shaft.

* * * * *

UNITED STATES PATENT AND TRADEMARK OFFICE

CERTIFICATE OF CORRECTION

PATENT NO. : 7,025,691 B2
APPLICATION NO. : 10/897525
DATED : April 11, 2006
INVENTOR(S) : Matsumoto et al.

It is certified that error appears in the above-identified patent and that said Letters Patent is hereby corrected as shown below:

Title Page, item [75] Inventors: delete “Haramachi” and replace with --Haramachi-shi--.

Column 6, Claim 3, line 44, please delete the word “at” and replace with --of--.

Column 6, Claim 4, line 50, after the word “rigidity” please insert --distribution curve is defined as a curve showing variation of said flexural rigidity--.

Signed and Sealed this

First Day of August, 2006

JON W. DUDAS
*Director of the United States Patent and Trademark Office*